US008876252B2

(12) United States Patent
Gehrin

(10) Patent No.: US 8,876,252 B2
(45) Date of Patent: Nov. 4, 2014

(54) SOLVENT FLUSHING FOR FLUID JET DEVICE

(75) Inventor: Robert E. Gehrin, Dardenne Prairie, MO (US)

(73) Assignee: Illinois Tool Works, Inc., Glenview, IL (US)

( * ) Notice: Subject to any disclaimer, the term of this patent is extended or adjusted under 35 U.S.C. 154(b) by 89 days.

(21) Appl. No.: 13/401,267

(22) Filed: Feb. 21, 2012

(65) Prior Publication Data

US 2012/0280058 A1 Nov. 8, 2012

Related U.S. Application Data

(60) Provisional application No. 61/481,375, filed on May 2, 2011.

(51) Int. Cl.
*B41J 2/165* (2006.01)
*B05B 15/02* (2006.01)

(52) U.S. Cl.
CPC ..... *B41J 2/16552* (2013.01)
USPC ..... 347/28; 239/106

(58) Field of Classification Search
CPC ..... B41J 2/165; A01G 25/023
USPC ..... 347/22, 28; 239/106; 134/131, 148, 134/151, 175, 191
See application file for complete search history.

(56) References Cited

U.S. PATENT DOCUMENTS 4,215,818 A * 8/1980 Hopkinson ..... 239/3
4,528,996 A 7/1985 Jones
4,814,794 A * 3/1989 Sato ..... 347/28
4,959,662 A 9/1990 Kobayashi
5,543,827 A 8/1996 VanSteenkiste et al.
5,706,039 A 1/1998 Chamberlain et al.
5,877,788 A * 3/1999 Haan et al. ..... 347/28

(Continued)

FOREIGN PATENT DOCUMENTS

| | | |
|---|---|---|
| DE | 3719704 | 12/1987 |
| EP | 0749836 | 12/1996 |
| GB | 2280149 | 1/1995 |
| WO | WO 96/35584 | 11/1996 |

OTHER PUBLICATIONS

International Patent Application No. PCT/US2010/035940 : International Search Report and Written Opinion, dated Jul. 5, 2012, 10 pages.

*Primary Examiner* — Matthew Luu
*Assistant Examiner* — Patrick King
(74) *Attorney, Agent, or Firm* — Baker & Hostetler LLP

(57) ABSTRACT

A solvent flushing apparatus comprises a plate that has an opening formed therein. The solvent flushing plate may be positioned relative to a fluid jet device so that the opening in the plate coincides with jet orifices of the jet device. The solvent flushing apparatus further comprises a conduit that is adapted to convey fluid therein. The conduit extends from proximate a first external side of the plate or body, and into the plate toward a second external side that is opposite the first external side. The conduit terminates at a conduit orifice that is spaced apart from the first external surface, faces the opening formed in the plate, and is directed toward, i.e., faces, at least in part, the orifices of the fluid jet device. A solvent fluid may be transported through the conduit and ejected from the orifice toward the plurality of orifices of the fluid jet device.

17 Claims, 6 Drawing Sheets

(56) References Cited

U.S. PATENT DOCUMENTS

| | | | | |
|---|---|---|---|---|
| 6,142,601 | A | 11/2000 | Sharma et al. | |
| 6,145,952 | A | 11/2000 | Sharma et al. | |
| 6,168,256 | B1 | 1/2001 | Sharma et al. | |
| 6,183,058 | B1 | 2/2001 | Sharma et al. | |
| 6,347,858 | B1 | 2/2002 | Faisst, Jr. et al. | |
| 6,406,122 | B1 * | 6/2002 | Sharma et al. | 347/28 |
| 6,435,647 | B2 | 8/2002 | Faisst, Jr. et al. | |
| 6,513,903 | B2 | 2/2003 | Sharma et al. | |
| 6,523,930 | B2 | 2/2003 | Griffin et al. | |
| 6,550,889 | B2 | 4/2003 | Colombat et al. | |
| 6,572,215 | B2 | 6/2003 | Sharma | |
| 6,575,556 | B1 | 6/2003 | Eremity et al. | |
| 6,595,617 | B2 | 7/2003 | Sharma et al. | |
| 6,802,588 | B2 | 10/2004 | Garbacz et al. | |
| 6,869,161 | B2 | 3/2005 | Wouters et al. | |
| 7,128,410 | B2 * | 10/2006 | Levin et al. | 347/90 |
| 7,150,512 | B2 | 12/2006 | Levin et al. | |
| 7,645,021 | B2 | 1/2010 | Turner et al. | |
| 7,784,474 | B2 * | 8/2010 | Kondos | 134/123 |
| 8,474,949 | B2 * | 7/2013 | Kimura et al. | 347/30 |
| 2003/0209613 | A1 * | 11/2003 | Miyauchi et al. | 239/418 |
| 2005/0206673 | A1 * | 9/2005 | Levin et al. | 347/28 |
| 2007/0188542 | A1 * | 8/2007 | Kanfoush et al. | 347/21 |
| 2007/0252863 | A1 * | 11/2007 | Sun et al. | 347/28 |
| 2008/0048054 | A1 * | 2/2008 | Peters et al. | 239/438 |
| 2009/0303280 | A1 | 12/2009 | Heo et al. | |
| 2011/0234693 | A1 * | 9/2011 | Yamaguchi et al. | 347/28 |

* cited by examiner

SOLVENT FLUSHING FOR FLUID JET DEVICE

CROSS REFERENCE TO RELATED APPLICATIONS

The present application claims priority to U.S. provisional patent application No. 61/481,375 filed on May 2, 2011, titled "Solvent Flushing For Fluid Jet Device," the contents of which are hereby incorporated herein by reference in their entirety.

BACKGROUND

Fluid jet devices operate by ejecting fluid from one or more orifices. A fluid jet device may be specially designed and the fluid specially selected for any of numerous different applications. For example, a fluid jet device may be designed to eject ink such as in a print head.

During operation of fluid jet devices such as ink jet printers, the fluid ejection orifices sometimes become obstructed with fluid residue. For example, in some ink jet applications, soon after a droplet of ink is ejected from an orifice, ink starts localized drying, sometimes referred to as skinning-over, at and around the orifices. Ink frequently splatters in the area of the orifices and begins drying on the print head.

The aggregation of ink in the vicinity of the jetting orifice (s) can cause the orifices to become clogged and/or cause deflection of ink that is jettisoned from the orifices. The aggregation of fluid residue is particularly troublesome for fluids that begin drying quickly after ejection from an orifice. For example, non-porous inks that are used in some ink jet printer applications are quick to begin drying and tend to be much harder after curing than other types of inks.

SUMMARY

Applicant discloses a solvent flushing apparatus and methods that facilitate the application of a fluid such as a solvent to the area of the jet orifices so as to remove residue that may have accumulated in the area. In an example embodiment, the solvent flushing apparatus comprises a plate or body that has an opening formed therein. In an exemplary scenario, the solvent flushing plate may be positioned relative to a fluid jet device, e.g., an ink print head, so that the opening in the plate coincides with jet orifices of the jet device. The solvent flushing apparatus further comprises a conduit that is adapted to convey fluid therein. The conduit extends from proximate a first external side of the plate or body, and into the plate toward a second external side that is opposite the first external side. The conduit terminates at a conduit orifice that is spaced apart from the first external surface, faces the opening formed in the plate, and is directed toward, i.e., faces, at least in part, the orifices of the fluid jet device. A solvent fluid may be transported through the conduit and ejected from the orifice toward the plurality of orifices of the fluid jet device. In an example embodiment, the solvent fluid is pressurized. The cleansing properties of the solvent fluid, in combination with the pressurized flow, cause residue, e.g., dirt, dried ink, etc., to be removed from the area of the jet device face plate where the jetting orifices were formed.

The conduit may have any suitable format or shape. For example, the conduit may comprise a hollowed area and/or tunnel in the flushing plate. The conduit may further comprise a tube, which may be secured in position relative to the device plate or body by a retaining member. In one exemplary embodiment, the conduit comprises a first conduit portion that extends away from the first external side of the plate. A second conduit portion is coupled with the first conduit portion and extends in a direction that is at least partially parallel to the first external side. A third conduit portion is communicatively coupled with the second portion and extends, at least in part, toward the first external side of the plate. In an exemplary scenario, the first conduit portion extends substantially perpendicular to the first external side, the second conduit portion extends substantially perpendicular to the first conduit portion, and the third conduit portion extends at an obtuse angle relative to the second conduit portion.

In an exemplary embodiment wherein the conduit comprises a tube, the tube may comprise a first tube portion that extends away from the first external side, and a second tube portion that extends in a direction substantially parallel to the first external side. A retaining member abuts the second tube portion and secures the tube relative to the solvent flushing plate. In an exemplary embodiment, the solvent flushing plate comprises a hole or tunnel formed therein that extends from the first external side to a recess formed in the second external side of the plate. The tube is positioned in the hole and in the recess. In an embodiment, the first tube portion may extend away from the first external side and is positioned in the hole or tunnel. The second tube portion extends in a direction substantially parallel to the first external side and is positioned in the recess formed in the second external side. An illustrative apparatus may further comprise a ring or washer that abuts the tube and the plate and thereby maintains the tube in position relative to the plate. The apparatus may further comprise an inlet that is cooperatively coupled to the tube and extends away from the first external surface. The inlet may be adapted, for example, to be cooperatively coupled with a fluid source. The fluid, which may be, for example, a solvent or cleansing solution, is received into the inlet from the fluid source and communicated through the conduit, and eventually ejected from the conduit orifice into the opening formed in the plate.

According to an aspect of the disclosed embodiments, a fluid jet device may comprise a first plate with a plurality of orifices formed therein, and a solvent flushing plate. The plurality of orifices may be adapted to eject a fluid such as, for example, ink. The solvent flushing plate is positioned in proximity to the first plate and positioned relative to the first plate such that the opening that is formed in the solvent flushing plate corresponds to and aligns with the plurality of orifices formed in the first plate. A gasket may be positioned between the first plate and the solvent flushing plate. The conduit of the solvent flushing plate extends from proximate the first external side of the solvent flushing plate toward the second external side and terminates in a conduit orifice that is spaced apart from the first external side, faces the opening formed in the solvent flushing plate, and faces the first plate having a plurality of orifices. In an exemplary embodiment, the plurality of orifices are formed in a substantially linear pattern across the first plate and the opening formed in the solvent flushing plate has a substantially elongated shape. In an exemplary embodiment, the conduit orifice is positioned substantially proximate to a terminal end of the elongated shape. The first plate may comprise a vacuum opening formed therein proximate a termination location of the plurality of orifices. In an exemplary embodiment, the conduit orifice may be formed at an opposing end of the plurality of orifices relative to the vacuum opening. Fluid, which may be, for example, a solvent or cleaner, is ejected from the conduit orifice in the direction of the first plate and the orifices formed therein. The fluid moves across the surface of the first plate and removes residue from the area of the orifices. The fluid and any residue suspended in the fluid is collected at the vacuum opening formed in the first plate. The fluid and the residue may be expelled from the fluid jet device.

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter. Other features are described below.

DETAILED DESCRIPTION OF ILLUSTRATIVE EMBODIMENTS

Overview

During operation of fluid jet devices such as ink jet printers, the fluid ejection orifices sometimes become obstructed with fluid residue. For example, in some ink jet applications, soon after a droplet of ink is ejected from an orifice, ink starts localized drying at and around the orifices. Moreover, ink often splatters in the area of the orifices and begins drying on the print head. The aggregation of ink in the vicinity of the jetting orifice(s) can cause the orifices to become clogged and/or cause deflection of ink that is jettisoned from the orifices.

Applicant discloses a solvent flushing apparatus that facilitates the application of a fluid such as a solvent to the area of the jet orifices of a jet device so as to remove residue that may have accumulated in the area. In an example embodiment, the solvent flushing apparatus comprises a plate and a conduit adapted for moving and jetting solvent fluid. In an exemplary scenario, the plate may be positioned relative to a fluid jet device, e.g., a jet printer, so that an opening in the plate is aligned with and coincides with jet orifices of the jet device. The conduit extends from proximate a first external side of the solvent flushing plate, and into the plate toward a second external side that is opposite the first external side. The conduit terminates at a conduit orifice that is spaced apart from the first external surface, faces the opening formed in the plate, and is directed toward, or faces, at least in part, the orifices of the fluid jet device. A pressurized solvent fluid is transported through the conduit and ejected from the orifice toward the plurality of orifices of the fluid jet device. Cleaning characteristics of the solvent fluid, in combination with the pressurized flow, result in the solvent fluid removing residue from the area of the face plate where the orifices are formed.

Illustrative Embodiments

Figure 1:
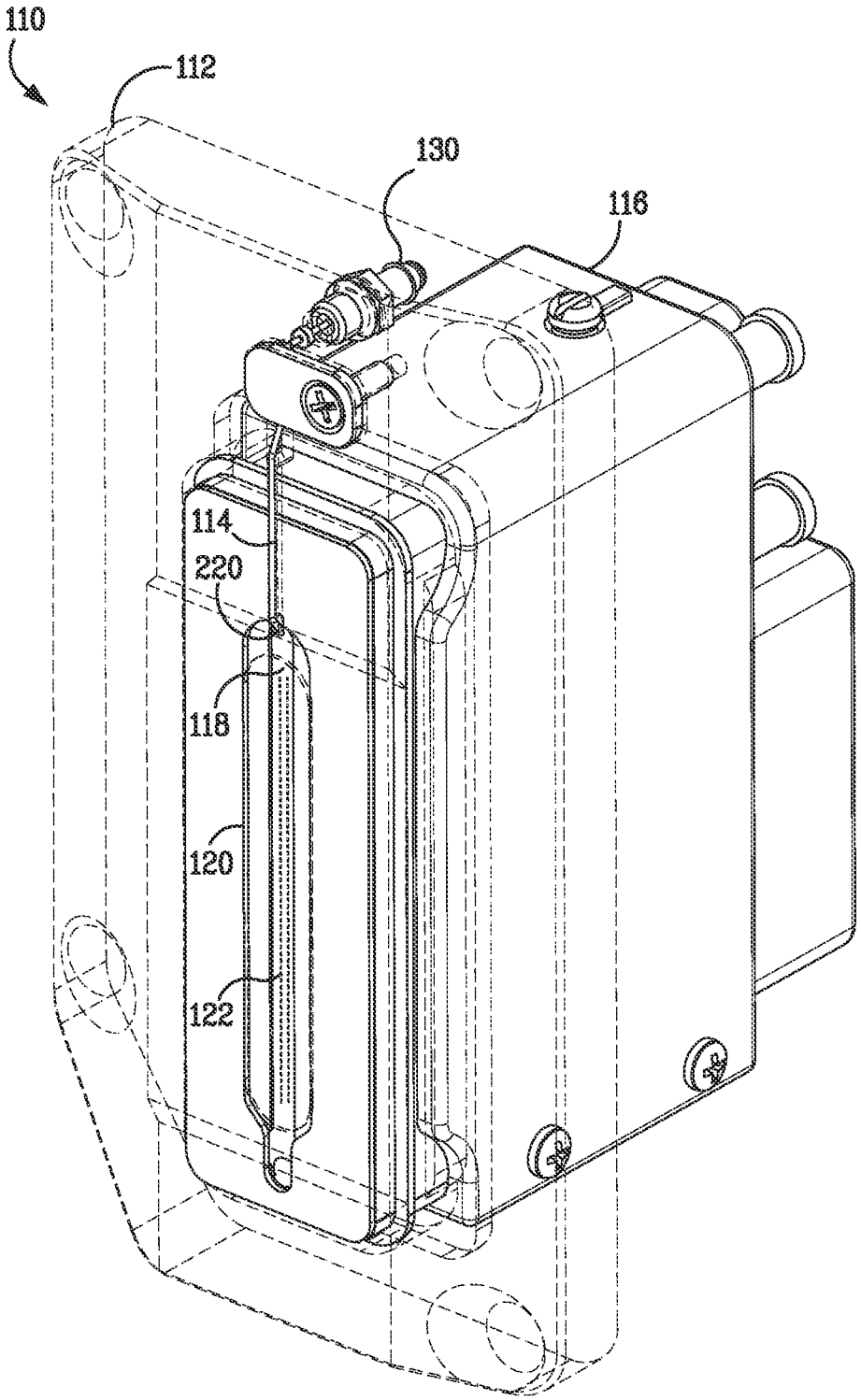
FIG. 1 is a perspective view of a fluid jet device comprising an illustrative solvent flushing apparatus.

FIG. 1 is a perspective view of a fluid jet device comprising an illustrative solvent flushing apparatus 110 and print engine 116. In the example embodiment depicted in FIG. 1, a solvent flushing apparatus 110 comprises solvent flushing plate 112 and conduit 114. Solvent flushing plate 112 is illustrated in partial transparency for purposes of explanation only; those skilled in the art appreciate that plate 112 may be formed of any suitable material to provide the functionality as described herein. In an exemplary embodiment, solvent flushing plate 112 is positioned in proximity to print engine 116, which may be, for example, an ink jet print engine adapted to eject ink from a plurality of orifices 122 formed in orifice plate 118 As illustrated in FIG. 5 and discussed below, solvent flushing apparatus 110 and print engine 116 may be comprised in a print head apparatus.

In an illustrative embodiment, solvent flushing plate 112 has an opening 120 formed therein. The solvent flushing plate 112 is positioned relative to print engine 116 so that opening 120 coincides with the plurality of orifices 122 formed in orifice plate 118. Pressurized solvent is received into inlet 130 and communicated by conduit 114 to a conduit orifice 220 that: empties into opening 120; is separated from orifice plate 118; and is directed toward orifice plate 118. The ejected pressurized solvent moves across the surface of orifice plate 118 and operates to remove unwanted material including, for example, dirt, debris, and ink, from the surface of the orifice plate 118.

Figure 2:
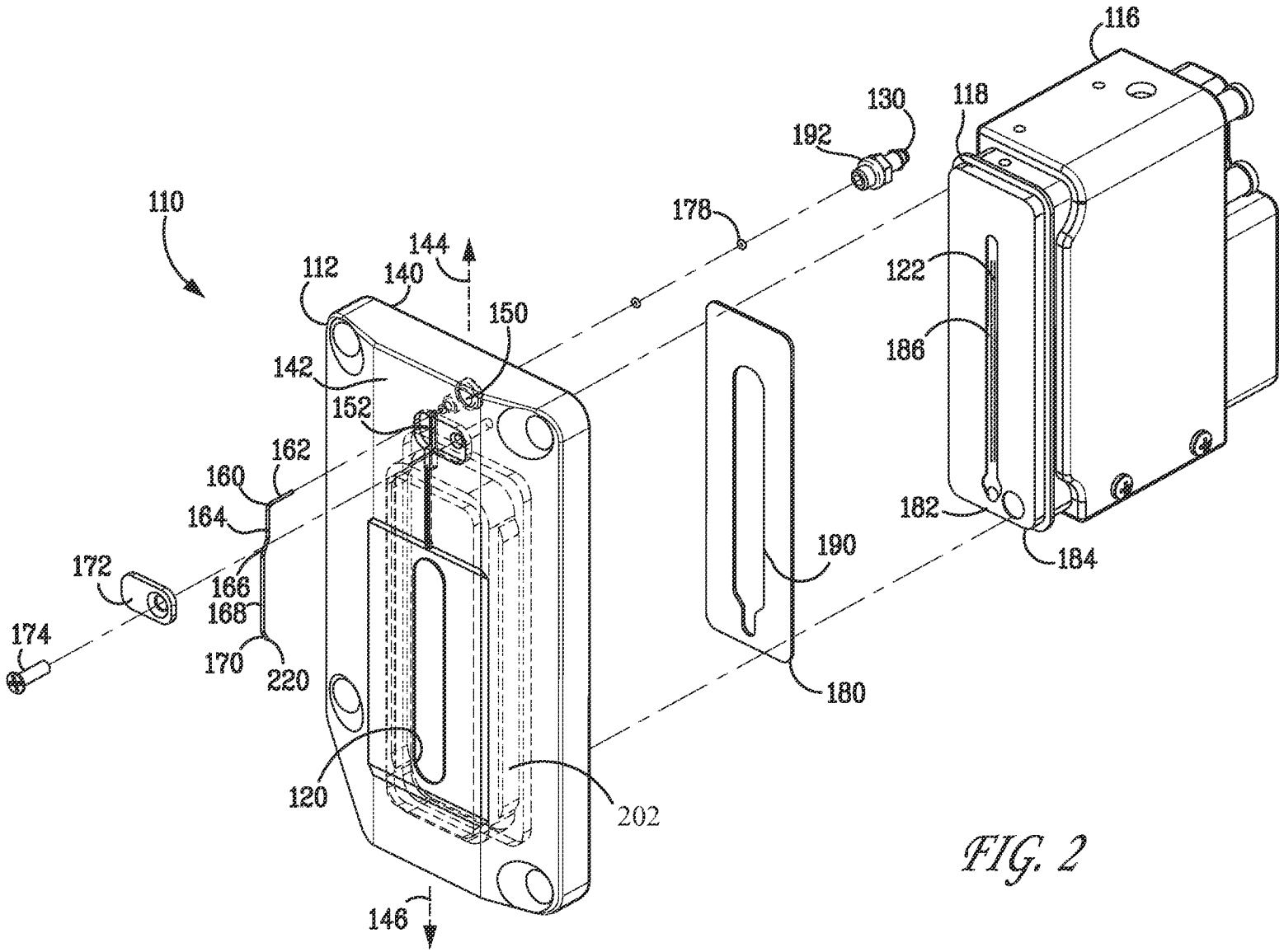
FIG. 2 is an exploded perspective view of a fluid jet device comprising an illustrative solvent flushing apparatus.

FIG. 2 provides an exploded view of an illustrative solvent flushing apparatus 110 and print engine 116. As shown, solvent flushing apparatus 110 comprises a solvent flushing plate 112. Solvent flushing plate 112 has a first external side 140 and a second external side 142. At least a portion of first external side 140 is formed in a first plane 144. At least a portion of the second external side 142 is formed in a second plane 146.

First external side 140 has an opening 150 or recess formed therein. The opening or recess 150 extends into solvent flushing plate 112. In an exemplary embodiment, opening 150 extends substantially perpendicularly to plane 144 and first external side 140. In an example embodiment, opening 150 extends through solvent flushing plate 112 and terminates in recess 152 formed in second external side 142. In an alternate embodiment, opening 150 may extend only partially through flushing plate 112 to a tunnel formed in plate 112.

In the example embodiment, solvent flushing apparatus 110 comprises a conduit for communicating pressurized solvent from the first external side 140 to opening 120 formed in plate 112. Any conduit suitable for performing this function may be used. For example, the conduit may be formed by a hollowed formation within solvent flushing plate 112. The hollowed formation may be milled and/or drilled in plate 112. The conduit extends from the first external side 140, through plate 112, and terminates at opening 120.

In an exemplary embodiment, the conduit may comprise any component such as, for example, solvent flushing tube 160. In an exemplary embodiment, solvent flushing tube 160 may be formed from any material suitable for communicating solvent fluid. For example, flushing tube 160 may be formed of plastic and/or metallic material. Solvent flushing tube 160 may have any configuration that is suitable for communicating solvent to opening 120 formed in plate 112. In the example embodiment of FIG. 2, tube 160 comprises a first conduit portion 162, second conduit portion 164, third conduit portion 166, fourth conduit portion 168, and fifth conduit portion 170. In an exemplary embodiment, first conduit portion 162 extends substantially perpendicular to first plane 144 and first external side 140. Second conduit portion 164 extends substantially perpendicularly to first conduit portion 162 and parallel to first plane 144 and first external side 140. Third conduit portion 166 extends at an obtuse angle relative to second conduit portion 164. Fourth conduit portion 168 extends at an obtuse angle relative to third conduit portion 166 and substantially parallel to second conduit portion 164 and first external side 140. Fifth conduit portion 170 extends at an obtuse angle relative to fourth conduit portion 168 and terminates in a conduit orifice 220. Fifth conduit portion 170 extends into recess or opening 120. Conduit orifice 220 faces into opening 120, is spaced apart from first plane 144, and faces, at least in part, first plane 144. In an embodiment wherein the solvent flushing plate 112 is positioned in proximity to orifice plate 118, conduit orifice 220 is directed at or faces into opening 120, is spaced apart from orifice plate 118, and is directed at or faces, at least in part orifice plate 118 and plurality of orifices 122.

In an exemplary embodiment, first conduit portion 162 is adapted to be received in opening 150 formed in plate 112. Second conduit portion 164, third conduit portion 166, and fourth conduit portion 168 are received into recess 152 formed in second external side 142 of plate 112. Recess 152 may have several different portions, each of which has varying depths. Conduit portions 164, 166, and 168 are configured relative to each other in order to accommodate the varying depths of recess 152. In an exemplary embodiment, fifth conduit portion 170 extends into and through a hole formed in plate 112.

In an exemplary embodiment, retaining member 172 abuts second conduit portion 164 so as to secure tube 160 in position relative to plate 112. Retaining member 172 is coupled to plate 112 by screw 174 which forms an interference fit with plate 112. Retaining member 172 may have any composition and configuration that is suitable for retaining conduit 160 to plate 112.

In an exemplary embodiment, one or more gaskets 178 abut first conduit portion 162. In one particular embodiment, first conduit portion 162 extends through gaskets 178. Gaskets 178 also form a mechanical fit with opening 150 formed in plate 112 and operate to position conduit portion 162 in opening or recess 150. Gaskets 178 may also form a seal to prevent liquid from proceeding through opening 150 and into plate 112.

Inlet 130 is configured with gasket 192 which forms a mechanical fit with opening 150 formed in plate 112. Inlet 130 is adapted to be cooperatively coupled with a source of fluid, which may be, for example, a source of solvent. Fluid is received into inlet 130 and communicated into and through conduit 160 and eventually ejected from conduit orifice 220 toward first plane 144 and orifice plate 116.

Solvent flushing plate 112 may be positioned in proximity to orifice plate 118 and the plurality of orifices 122 formed in plate 118. In one embodiment, solvent flushing plate 112 is positioned relative to orifice plate 118 so that opening 120 coincides with plurality of orifices 122 formed in plate 118. Fluid ejected from conduit orifice 220 is dispersed on orifice plate 118 in the area of the plurality of orifices 122.

In an exemplary embodiment, orifice plate 118 has a vacuum opening 182 formed therein. Vacuum opening 182 may be adapted to form a vacuum force in the area of opening 182. Fluid that is in the area of opening 182, which may include fluid ejected onto orifice plate 118 from conduit orifice 220, may be vacuumed into opening 182 and communicated away from the plurality of orifices 122. Accordingly, solvent that is extinguished from conduit 160 may flow over and around plurality of orifices 122 and ultimately collected into vacuum opening 182.

In an exemplary embodiment, plurality of orifices 122 are formed in a substantially linear pattern across orifice plate 118 and opening 120 formed in solvent flushing plate 112 has a substantially elongated shape. Conduit orifice 220 is positioned substantially proximate a terminal end of the elongated shape. Vacuum opening 182 is formed proximate a termination location of the plurality of orifices. In an exemplary embodiment, conduit orifice 220 may be formed at an opposing end of the plurality of orifices relative to vacuum opening 182. Fluid, which may be, for example, a solvent or cleaner, is ejected from conduit orifice 220 in the direction of orifice plate 118 and orifices 122 formed therein. The fluid moves across the surface of orifice plate 118 and removes residue from the area of orifices 122. The fluid and any residue suspended in the fluid is collected at vacuum opening 182 formed in orifice plate 118. The fluid and the residue may then be expelled from the fluid jet device.

In an embodiment, a maintenance plate 184 may be positioned over orifice plate 118. Maintenance plate 184 may have at least one opening 186 formed therein that may be positioned so as to correspond with or coincide with plurality of orifices 122 formed in orifice plate 118. In an exemplary embodiment, opening 186 further coincides with vacuum opening formed in orifice plate 122. Opening 120 formed in solvent flushing plate 112 coincides with opening 186 so that solvent extinguished from conduit 160 passes through opening 186 and is received on orifice plate 118. In an exemplary embodiment, maintenance plate 184 and orifice plate 118 may comprise a maintenance module as described in U.S. Pat. No. 6,637,862, the contents of which are hereby incorporated herein by reference in their entirety.

In an exemplary embodiment, gasket 180 may be positioned between solvent flushing plate 112 and orifice plate 118. In an embodiment, gasket 180 is positioned adjacent to maintenance plate 184 and solvent flushing plate 112. In an exemplary embodiment, gasket 180 has an opening 190 formed therein that coincides with plurality of orifices 122 formed in orifice plate 118. Opening 120 formed in solvent plate 112 coincides with opening 190 formed in gasket 180 and with opening 186 formed in maintenance plate 184 so that solvent extinguished from conduit 160 pass through opening 190 and opening 186 and is received on orifice plate 118.

In a potential embodiment, solvent flushing plate 112 may have a recess 202 formed therein that corresponds to, and receives therein, gasket 180, maintenance plate 184, and orifice plate 118.

Figure 3:
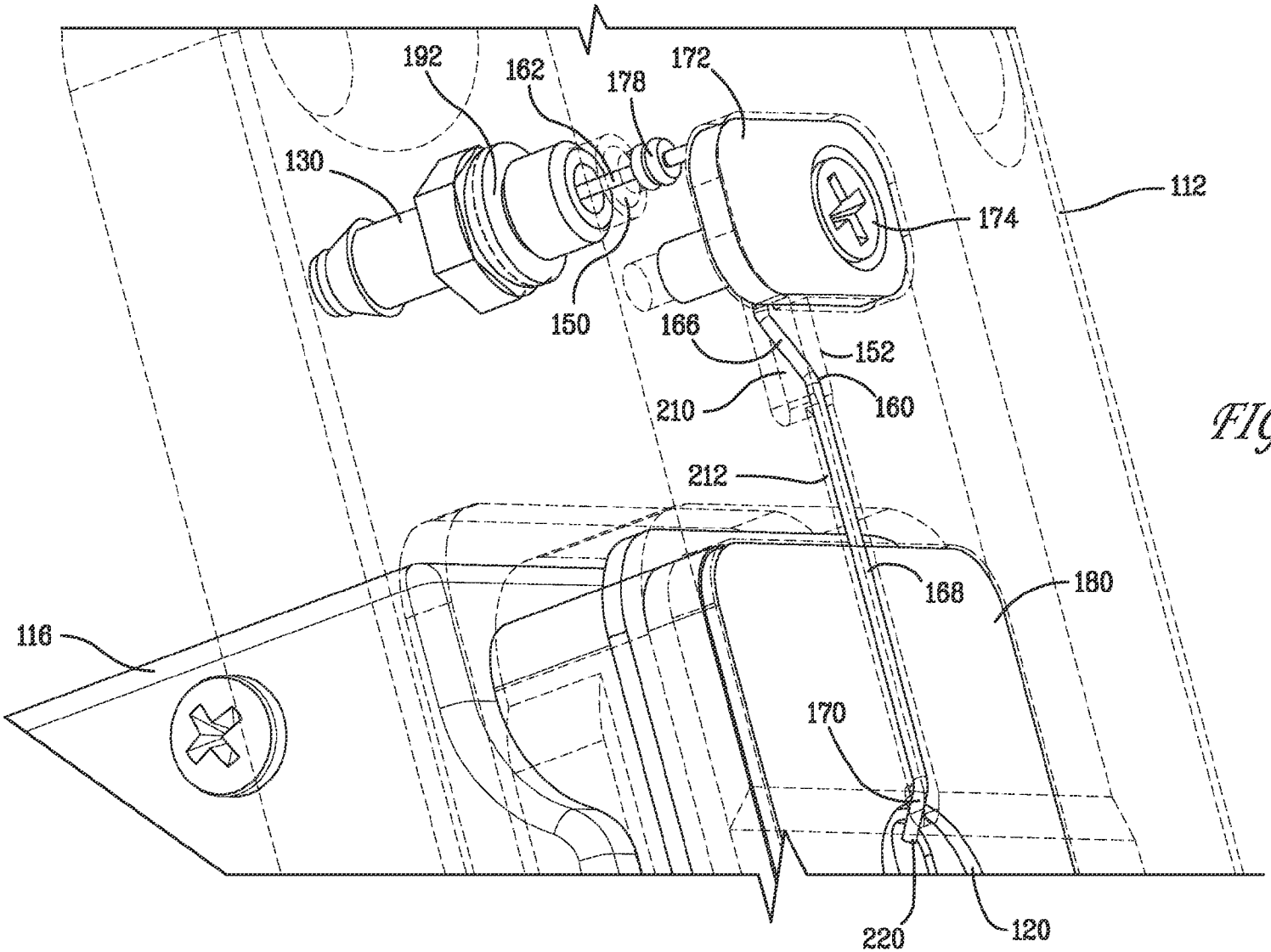
FIG. 3 is an isolated perspective view of a fluid jet device comprising an illustrative solvent flushing apparatus.
Figure 4:
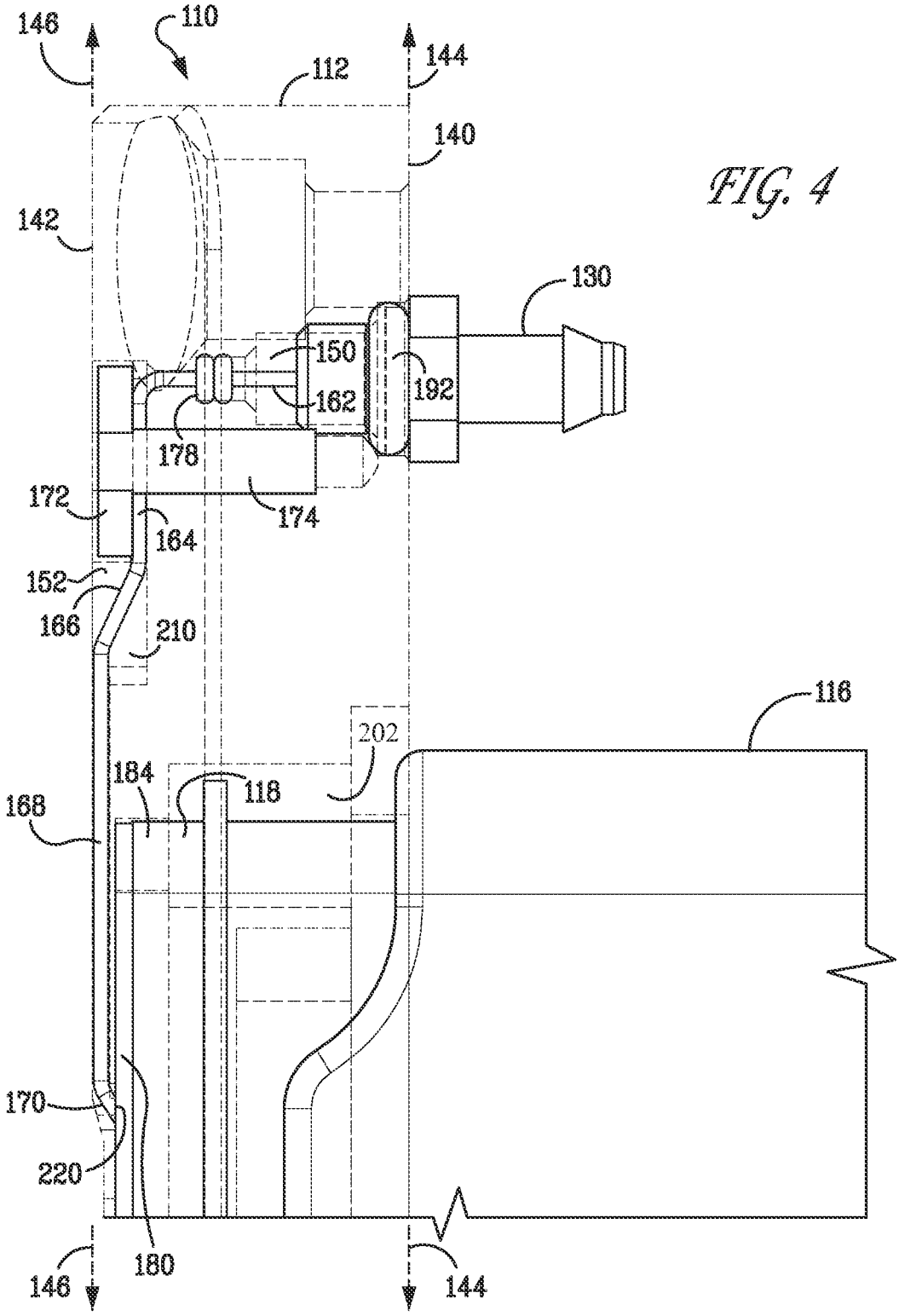
FIG. 4 is an isolated side view of a fluid jet device comprising an illustrative solvent flushing apparatus.

FIGS. 3 and 4 provide isolated views of a portion of solvent flushing plate 112 and conduit 160. As shown, first conduit portion 162 of conduit 160 is formed in opening 150. Gaskets 178 are formed around first portion 162 and abut solvent flushing plate 112. Fluid inlet 130 has a washer or gasket 192 formed thereon that forms an interference fit with solvent flushing plate 112. In an exemplary embodiment, first conduit portion 162 is suspended in opening or recess 150 formed in inlet 130. Fluid is received into fluid inlet 130 under pressure. The pressure causes the fluid to be forced into first conduit portion 162 and communicated through conduit 160. First conduit portion 162 is formed at an angle relative to external side 140 and plane 144. For example, first conduit portion 162 may extend substantially perpendicularly to external side 140 and plane 144.

Second conduit portion 164 is formed at an angle relative to first conduit portion 162. In an illustrative embodiment, second conduit portion 164 is formed at approximately a right angle or perpendicularly relative to first conduit portion 162 and extends at least in part substantially parallel to plane 144 and first external side 140. In an exemplary embodiment, second conduit portion 164 is positioned in recess 152 formed in second external side 142 of plate 112. In an exemplary embodiment, second conduit portion 164 is positioned in a first portion 210 of recess 152 that has a first depth. Retention member 172 abuts second conduit portion 164 and secures conduit 160 relative to solvent flushing plate 112.

Third conduit portion 166 is coupled with second conduit portion 164. In an exemplary embodiment, third conduit portion 166 is formed at an obtuse angle relative to second conduit portion 164 and extends at least in part away from first external side 140 and plane 144. In an exemplary embodiment, third conduit portion 166 extends and is positioned in recess 152 formed in second external side 142 of plate 112. Third conduit portion 166 extends from first portion 210 of recess 152 having a first depth to second portion 212 of recess that has a second depth. In other words, third conduit portion 166 transitions between a first depth of first portion 210 to a second depth of second portion 212. In an exemplary embodiment, the first depth is greater than the second depth.

Fourth conduit portion 168 is coupled with third conduit portion 166 and positioned in recess 152. In an exemplary embodiment, fourth conduit portion 168 is formed at an obtuse angle relative to third conduit portion 166 and extends substantially parallel to external side 140 and 144. In an illustrative embodiment, fourth conduit portion 168 is positioned in second portion 212 of recess 152.

Fifth conduit portion 170 is formed at an obtuse angle relative to fourth conduit portion 168 and terminates at conduit orifice 220. In an exemplary embodiment, fifth conduit portion 170 extends into or proximate opening 120 formed in solvent flushing plate 112. A distal end of fifth conduit portion 170 and conduit orifice 220 are directed toward first external side 140 of solvent flushing plate 112 and plane 144 formed parallel with external side 140. In an embodiment wherein flushing plate 112 is positioned adjacent to orifice plate, conduit orifice 220 is spaced apart from, but directed toward plurality of orifices 122 formed in orifice plate 118.

Figure 5A:
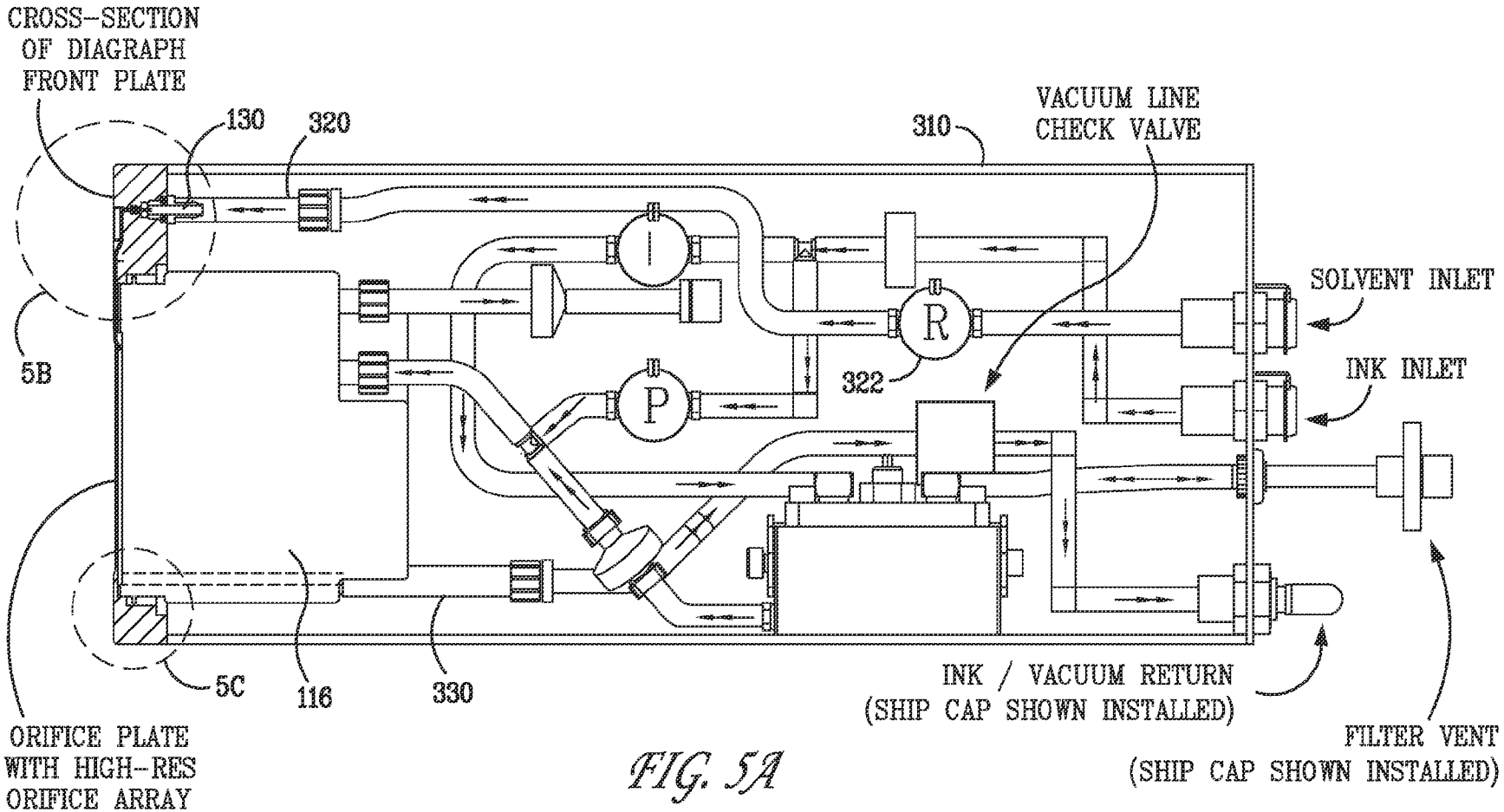
FIG. 5A-5C provide sectional views of an exemplary print head system comprising an illustrative solvent flushing apparatus.
Figure 5B:
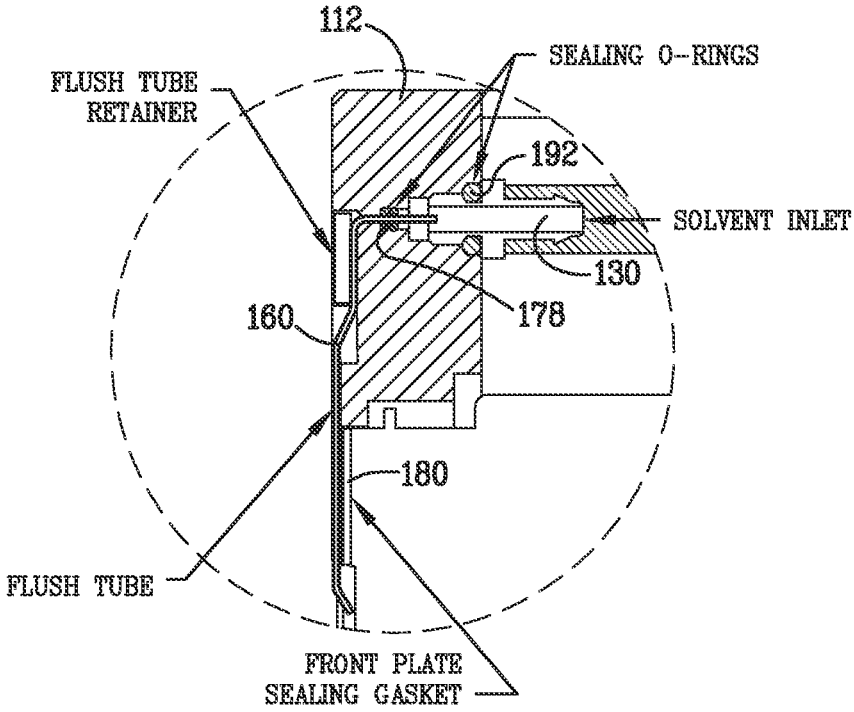
Figure 5C:
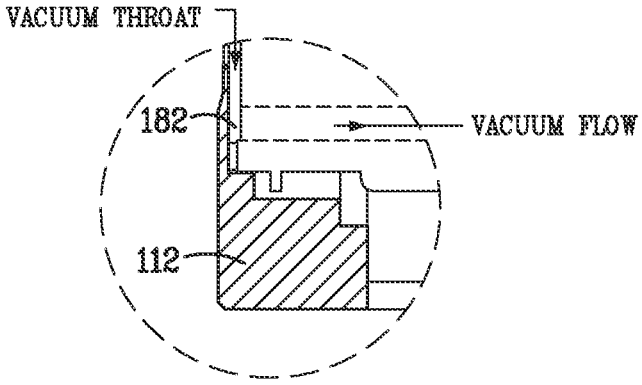

FIGS. 5A, 5B, and 5C illustrates an exemplary solvent flushing apparatus 110 comprised in print head apparatus 310. As shown, solvent flushing plate 112 is positioned along an externally facing side of print head apparatus 310. Solvent flushing plate 112 may be secured to print head apparatus 310 in any suitable manner. Solvent flushing plate 112 is positioned adjacent to print engine 116 consistent with the above-described embodiments. Ink is delivered to the rear of print engine 116 which ejects the ink from the plurality of orifices in orifice plate 118. Solvent fluid is delivered to solvent flushing apparatus 110 via solvent supply conduit 320 to inlet 130. Solenoid valve 322 may be opened and closed in order to control the flow of fluid to inlet 130. The solvent fluid is communicated from inlet 130 to conduit 160 which jets the fluid toward the plurality of orifices 122 formed on orifice plate 118. Solvent that has run over orifice plate 118 and collected in vacuum inlet 182 is communicated away from orifice plate 118 via vacuum conduit 330. Vacuum valve 332 operates to control the creation of a vacuum in vacuum conduit 330 and, as a consequence, at vacuum opening 182.

Print head apparatus 310 may comprise or be communicatively coupled to a computing controller. The controller controls the delivery of ink to print engine 114 and the ejection of ink from the plurality of orifices 122. The controller also controls the delivery of solvent to solvent flushing apparatus 110 and the removal of solvent residue via conduit 330. In an example embodiment, a controller may control valves 322 and 332 so as to control the flow of solvent and the vacuuming of residue. The controller may control the sequencing of ejection of ink from orifices 122 and the application of solvent via conduit 160 so as to optimize the removal of residue. For example, the controller may cause a vacuum force to be generated in the area of vacuum opening 182, followed by a small amount of ink being ejected from orifices 122, which is followed immediately by the application of solvent to the plurality of orifices. Any number of different sequences of operations may be applied so as to maximize the removal of residue from the area of orifices 122.

Thus, applicants have disclosed a solvent flushing apparatus that facilitates the application of a fluid such as a solvent to the area of the jet orifices of a jet device so as to remove residue that may have accumulated in the area. The solvent flushing apparatus comprises a plate and a conduit adapted for moving and jetting solvent fluid. The plate may be positioned relative to a fluid jet device, e.g., a jet printer, so that an opening in the plate is aligned with and coincides with jet orifices of the jet device. The conduit extends from proximate a first external side of the solvent flushing plate, and into the plate toward a second external side that is opposite the first external side. The conduit terminates at a conduit orifice that is spaced apart from the first external surface, faces the opening formed in the plate, and is directed toward, or faces, at least in part, the orifices of the fluid jet device. A pressurized solvent fluid is transported through the conduit and ejected from the orifice toward the plurality of orifices of the fluid jet device. Cleaning characteristics of the solvent fluid, in combination with the pressurized flow, result in the solvent fluid removing residue from the area of the face plate where the orifices are formed.

Although the subject matter has been described in language specific to structural features and/or methodological acts, it is to be understood that the subject matter defined in the appended claims is not limited to the specific features or acts described above. For example, in a described example, the conduit formed in solvent flushing plate comprises a tube. However, a conduit adapted to convey solvent fluid may take any form such as, for example, a tunnel formed in the flushing plate. Also, while the solvent flushing apparatus is described in connection with a print head, the solvent flushing apparatus may be employed with any type of fluid jet apparatus or device. The specific features and acts described above are disclosed as example forms of implementing the below-listed claims.

Thus, while various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed:

1. A fluid flushing apparatus, comprising:

a plate having a first external side formed at least in part in a first plane extending parallel to the first external side, the first external side adapted to be positioned toward a fluid jet device, and a second external side positioned opposite said first external side and formed at least in part in a second plane extending parallel to the second external side, the plate having an opening formed therein extending through the first plane and the second plane; and a conduit adapted to convey fluid therein, the conduit extending from proximate the first external side and into said plate toward the second external side, and terminating at an orifice, the orifice spaced apart from the first plane, facing the opening, and facing at least in part the first plane, wherein the plate has a hole formed therein extending from the first external side to a recess formed in the second external side, and wherein the conduit comprises a tube positioned in the hole and the recess.

2. The fluid flushing apparatus as recited in claim 1, wherein the conduit comprises:

a first conduit portion extending away from the first plane;

a second conduit portion extending in a direction at least partially in parallel to the first plane; and a third conduit portion extending at least in part toward the first plane.

3. The fluid flushing apparatus as recited in claim 2, wherein:

the first conduit portion extends away from the first plane substantially perpendicular to the first plane;

the second conduit portion extends substantially perpendicular to the first conduit portion; and the third conduit portion extends at an obtuse angle relative to the second conduit portion.

4. The fluid flushing apparatus as recited in claim 1, further comprising a retaining member, the retaining member abutting the tube.

5. The fluid flushing apparatus as recited in claim 4, wherein the tube comprises a first tube portion extending away from the first plane, and a second tube portion extending in a direction at least partially in parallel to the first plane, and further wherein the retaining member abuts the second tube portion.

6. The fluid flushing apparatus as recited in claim 1, further comprising at least a first ring, the at least a first ring forming an interference fit with the tube and the plate in the hole.

7. The fluid flushing apparatus as recited in claim 6, further comprising a retaining member, the retaining abutting the tube in the recess.

8. The fluid flushing apparatus as recited in claim 7, wherein the retaining member is secured to the plate by a fastener.

9. The fluid flushing apparatus as recited in claim 6, further comprising an inlet cooperatively coupled to the tube and extending away from the first external surface.

10. The fluid flushing apparatus as recited in claim 1, wherein the recess formed in the second external side comprises a first recess portion having a first depth relative to the second external side and a second recess portion having a second depth relative to the second external side, and further wherein the tube extends along the first recess portion and the second recess portion.

11. The fluid flushing apparatus as recited in claim 10, wherein the tube extends beyond the second recess portion and terminates in the orifice.

12. A fluid jet device, comprising:

a first plate comprising a plurality of orifices formed therein;

a second plate positioned proximate to the first plate, the second plate having a first external side, and a second external side positioned opposite said first external side, the second plate having an opening formed therein extending through the first external side and the second external side, the opening corresponding to and aligning with the plurality of orifices; and a conduit adapted to convey fluid therein, the conduit extending from proximate the first external side and into said second plate toward the second external side, and terminating at a conduit orifice, the conduit orifice spaced apart from the first external side, facing the opening, and facing at least in part the first plate, wherein the second plate has a hole formed therein extending from the first external side to a recess formed in the second external side, and wherein the conduit comprises a tube positioned in the hole and the recess.

13. The fluid jet device of claim 12, wherein the plurality of orifices are formed in a substantially linear pattern across the first plate and the opening has a substantially elongated shape.

14. The fluid jet device of claim 13, wherein the conduit orifice is positioned proximate a terminal end of the elongated shape.

15. The fluid jet device of claim 13, wherein the first plate comprises a vacuum opening formed therein proximate a termination location of the plurality of orifices.

16. The fluid jet device of claim 12, further comprising a gasket, the gasket positioned between the first plate and the second plate.

17. A module for a fluid jet device, comprising:

a first plate comprising a plurality of orifices formed therein, the plurality of orifices disposed in a substantially linear pattern across the first plate;

a second plate adjacent to the first plate, the second plate having a first external side, and a second external side positioned opposite said first external side, the second plate having an opening formed therein extending through the first external side and the second external side, the opening corresponding to and aligning with the plurality of orifices; and a tube adapted to convey fluid therein, the tube extending from proximate the first external side, into said second plate toward the second external side, and along a recess formed in the second external side, and terminating at a tube orifice, the tube orifice spaced apart from the first external side, facing the opening, and facing at least in part the first plate, wherein the second plate has a hole formed therein extending from the first external side to a recess formed in the second external side, and wherein the tube is positioned in the hole and the recess.

* * * * *